United States Patent [19]

Bente

[11] Patent Number: 4,551,931

[45] Date of Patent: Nov. 12, 1985

[54] SOLE FOR A CROSS-COUNTRY SKI BOOT AND ASSOCIATED BINDING BASE PLATE

[75] Inventor: Alfred Bente, Herzogenaurach, Fed. Rep. of Germany

[73] Assignee: Adi Dassler KG, Herzogenaurach, Fed. Rep. of Germany

[21] Appl. No.: 574,051

[22] Filed: Jan. 26, 1984

[30] Foreign Application Priority Data

Feb. 10, 1983 [DE] Fed. Rep. of Germany ..... 3304538

[51] Int. Cl.[4] ..... A43B 5/04

[52] U.S. Cl. ..... 36/117

[58] Field of Search ..... 36/117

[56] References Cited

U.S. PATENT DOCUMENTS 3,677,567 7/1972 Salomon ..... 36/117 X 4,392,313 7/1983 Linecker ..... 36/117

4,487,427 12/1984 Salomon ..... 36/117 X

*Primary Examiner*—Louis K. Rimrodt

[57] ABSTRACT

A sole for a cross-country ski boot has a front extension portion for securing it to a ski. Provided in or on the tread surface of the sole, in a transitional region between the front extension portion and the front portion of the actual sole, or somewhat rearwardly thereof, is at least one transverse groove or transverse rib associated with a matching transverse rib or groove on or in a base plate to be secured to the ski. The interengagement of the rib and groove provides that the sole of the boot is supported against lateral deflection or twisting movements with respect to the fixing point on the ski binding, even when the boot is raised comparatively far away from the top of the ski.

7 Claims, 3 Drawing Figures

II
II
2
3
4
7
9
10
1
2
3
5
6

SOLE FOR A CROSS-COUNTRY SKI BOOT AND ASSOCIATED BINDING BASE PLATE

BACKGROUND OF THE INVENTION

The present invention relates generally to a ski boot and more particularly to a ski boot intended for use in cross-country skiing, sometimes variously referred to as long-distance skiing or langlauf skiing or Nordic skiing; for the sake of convenience, the term cross-country skiing will be used in this specification. The invention is even more particularly concerned with a manner of securing a cross-country ski boot to an associated ski, and thus also concerns a base plate adapted to be secured to a ski and to co-operate with a ski boot.

In one form of cross-country ski boot, the sole thereof is provided with a front extension portion by means of which the sole can be secured to the top surface of the ski by means of a suitable ski binding. A rib and groove respectively extend in the longitudinal direction of the ski and the sole of the boot and when they come into positive co-operation with each other, they provide an additional support in a sideways direction for the foot of the skier, in addition to the holding action of the ski binding. It should be noted that, in cross-country skiing, the heel of the boot is lifted from the surface of the ski as the skier moves, with a rolling action somewhat similar to a normal walking action, thus contrasting with a downhill skiing motion in which the boot is firmly fixed to the ski both at the front and at the rear. Thus, when cross-country skiing, when the sole of the boot is moved back towards the top surface of the ski from the position of the boot in which the heel is raised therefrom, with the sole of the boot thus being somewhat curved, the longitudinal rib and groove come into increasing engagement with each other and thus prevent the boot from being deflected sideways, by virtue of the positive co-operation between rib and groove. In order to ensure that the sideways support for the boot on the ski comes into effect as early as possible in the movement of the boot on the ski, the longitudinal rib and groove may be so arranged as to extend as far as the tip of the sole or the front extension portion thereof. Nonetheless, when the boot is in a position in which the heel and a substantial part of the sole of the boot are lifted away from the top of the ski, it will be seen that there is at best a minimum condition of engagement between the longitudinal rib and the longitudinal groove so that, in that position of the boot and also in the first phase of the downward movement of the boot towards the ski, the sideways support action afforded by the interengagement of the rib and the groove is correspondingly slight. That is particularly noticeable in the case of those combinations of ski boot and ski binding in which the cross-country ski boot is held in position by the ski binding at a very far forward position, that is to say for example either at the front edge of the sole, as disclosed for example in DE-AS (German published specification) No. 26 22 966, or by means of a comparatively narrow front extension portion on the sole, for example as disclosed in DE-AS No. 26 10 041, with the front extension portion acting as a rolling tongue portion to permit the boot to roll and lift in relation to the surface of the ski, as referred to above. It will be appreciated that, with such arrangements, the holding forces produced by the ski binding are applied to the sole of the boot over a locally restricted portion thereof so that it is not possible for lateral bending and torsional deformation of the sole of the boot to be prevented satisfactorily under all circumstances. Although the interengageable longitudinal rib and groove may be of such a configuration that they can still come into engagement with each other, even when they are laterally displaced relative to each other to a certain degree, and have to a certain extent an alignment function, for example by virtue of the side surfaces of the rib and groove being inclined to give a form of centering action, nonetheless when the rib and the groove are somewhat more severely displaced relative to each other in a sideways direction, the above-mentioned alignment function or centering action is unpleasant from the point of view of the skier insofar as a shock or impact can be felt when the sole of the boot is set down on to the top surface of the ski and the rib and the groove adjust relative to each other so as to come into mutual engagement. In the limit case, when the rib and the groove are displaced laterally relative to each other to a particularly large degree, they may no longer come into engagement with each other, with obvious detrimental results.

SUMMARY OF THE INVENTION

An object of the present invention is to improve a cross-country or langlauf ski boot such as to provide improved lateral support even when the boot is lifted comparatively far away from the ski.

Another object of the present invention is to provide a cross-country ski boot which provides for more positive engagement thereof on the ski.

Still another object of the present invention is to provide a cross-country ski boot which provides for locating engagement as between the sole of the boot and the top surface of the ski over a substantially longer part of the skiing cycle of movements.

Yet another object of the present invention is to provide a base plate which is adapted to be secured to the top surface of a ski and for use in conjunction with a sole designed in accordance with the principles of the present invention.

According to this invention, these and other objects are achieved by means of a sole for a cross-country ski boot having a forward extension portion on the sole, for securing the sole to the ski by means of a ski binding, and at least one transversely extending positive engagement means on the surface of the sole, disposed at a transitional region between the forward extension portion and the front portion of the sole itself, or somewhat rearwardly of the transitional region as in the portion of the sole between the tip of the boot sole and the ball region thereof, and engageable with a matching engagement means on the top surface of the ski. The engagement means on the sole is for example at least one transverse groove or transverse rib which thus extends transversely with respect to the lengthwise direction of the sole and which is adapted to come into positive or form-locking engagement with the matching engagement means, such as at least one transverse rib or transverse groove respectively, on the top surface of the ski, or on a base plate securable thereto.

As has been noted above, when the boot is in the position in which it is raised relatively far from the top surface of the ski, in the course of the skiing movement, the interengagement between the longitudinal rib and the longitudinal groove can effectively only occur in the region which, during that phase of movement, is still in contact with the surface of the ski or which comes back into contact with the top surface of the ski at least comparatively early at the beginning of the return movement of the boot towards the ski, that is to say, a downward movement of the heel of the boot towards the ski. However, it will be appreciated that, in the case of a combination of rib and groove extending in the longitudinal direction of the ski boot and the ski, an adequate positive interengagement between the rib and the groove will occur only at a comparatively late stage in the downward movement of the boot towards the top of the ski, thus restricting the additional support which the rib and the groove are specifically intended to provide. With the transversely extending rib and groove combination in accordance with the principles of this invention however, being disposed in the region in which the sole of the boot bends in the course of the skiing movements of the foot of the skier, complete positive interengagement occurs over the entire length of the rib and the groove configuration as soon as that part of the sole of the boot has come into contact with the top surface of the ski, as the boot rolls down on to the surface of the ski. Therefore, in that phase of the skiing movement, the side surfaces or flanks of the rib and the groove come into full engagement with each other, thereby providing the required additional support and holding action, in regard to sideways movement of the sole of the boot on the ski.

In an advantageous embodiment of the sole according to the present invention, the transversely extending rib or groove is combined with at least one corresponding groove or rib extending in the lengthwise direction of the sole of the boot. That arrangement compensates for the deviations and clearances which can rarely be entirely eliminated and which in some cases are even deliberately provided between the rib or groove on the sole of the boot and the groove or rib on the top surface of the ski, being formed for example on a base plate which can be secured to the surface of the ski, thereby ensuring that the boot is guided on the ski with a higher degree of accuracy.

The at least one transverse groove or rib which is provided in the sole of the boot in accordance with the invention and the at least one corresponding rib or groove which is engageable therewith are disposed in that region of the sole of the boot in which the boot experiences vigorous bending, while at the same time bearing against the top of the ski. In the case of soles which have a front extension portion thereon, the bending region is disposed at the rearward end region of the front extension portion of the sole, that is to say, in the region constituting the transitional portion between the front extension portion of the sole and the front part of the sole itself.

Another advantageous embodiment provides that the sole of the boot has at least one transverse groove which extends through the lateral edge of the sole, being therefore open in a sideways direction. That groove configuration provides that any snow or dirt or other fouling matter which has penetrated into and accumulated in the groove can be more easily removed by being displaced sideways and thus out of the ends of the groove, at the sides of the sole. That cleaning action can be further enhanced if, with the transverse groove in the sole of the boot being of a substantially constant depth over its entire length, the transverse rib which is engageable thereinto decreases in height somewhat from the centre of the sole towards both sides thereof.

In another aspect of the present invention, there is provided a base plate which is adapted to be secured to the top surface of a ski, for use with a cross-country ski boot fitted with a sole in accordance with the principles of the present invention. The base plate thus has at least one transverse rib or transverse groove which therefore extends transversely with respect to the longitudinal direction of the ski and which is adapted to engage with the corresponding transverse groove or rib provided by the sole of the cross-country ski boot. The base plate may additionally have a longitudinally extending rib or groove, adapted to co-operate with a corresponding groove or rib provided by the sole of the boot to be fitted thereto.

Further objects, features and advantages of the present invention will be apparent from the following description of a preferred embodiment of a cross-country ski boot sole and base plate co-operable therewith, in accordance with the teachings of this invention.

DESCRIPTION OF A PREFERRED EMBODIMENT

Figures 1, 2:
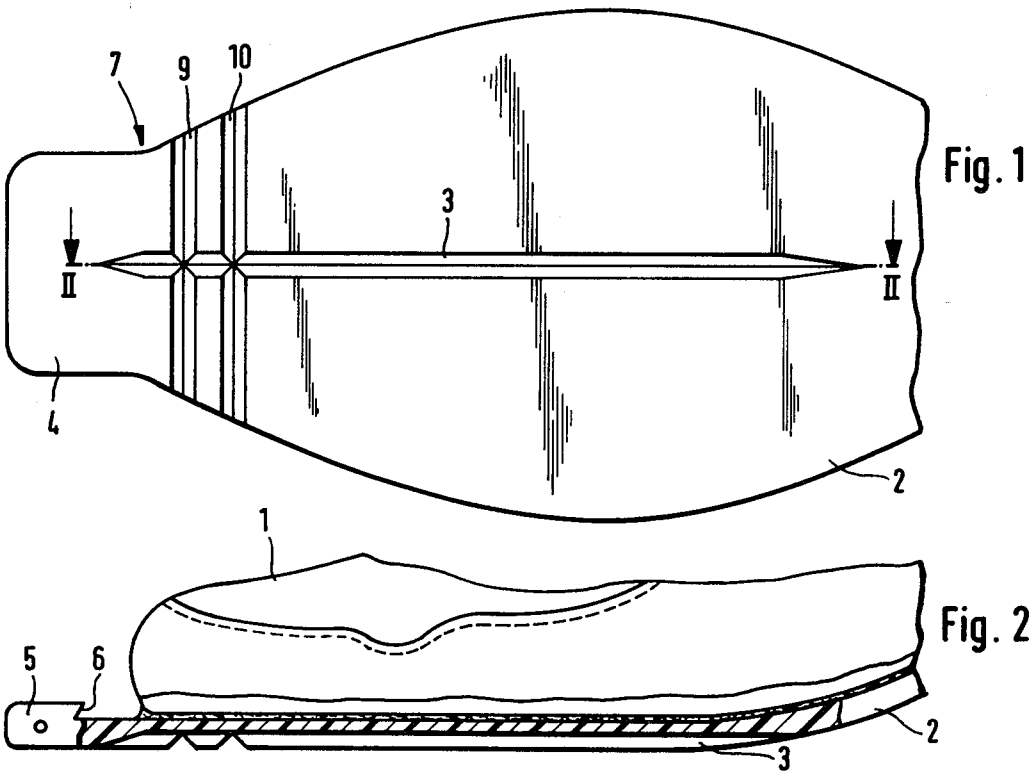
FIG. 1 shows a view from below of the front portion of the sole of a cross-country ski boot.
FIG. 2 shows a side view of the FIG. 1 sole in partial cross-section taken along line II—II in FIG. 1.

Referring firstly to FIGS. 1 and 2, and more particularly FIG. 2, shown therein is part of a ski boot intended for use on a cross-country ski. FIG. 2 shows that the boot comprises an uppers portion 1, the shape and configuration of which are of no importance in regard to the present invention, and a sole 2 which is suitably joined to the portion 1 and which comprises a resiliently bendable plastic material, for example hard polyamide, or rubber or other suitable material. The tread or downward surface of the sole 2 is provided with a suitable tread pattern or profile (not shown) which affords a certain degree of resistance to slipping when walking in the boot. At its front end, the sole 2 has a front extension portion 4 which is narrower than the width of a ski to which the boot is to be fixed and which forms a front end portion 5 which is of increased thickness, defining a rearwardly facing shoulder 6.

As shown in FIG. 1, the downwardly facing or tread surface of the sole 2 is provided, approximately on the centre line thereof, with a longitudinally extending groove 3 which is for example of triangular cross-section. As can be seen from FIG. 1, the groove 3 terminates at its front and rear ends in a pointed configuration. FIG. 2 shows that, at a transitional portion, indicated at 7 in FIG. 1, between the front extension portion 4 on the sole and the main body portion of the sole 2 itself, the groove 3 progressively decreases in depth to define a tapered configuration so that it comes to the tread surface of the sole 2. At its rearward end, the groove 3 extends as far as the joint of the foot, where it terminates with the configuration most clearly seen from FIG. 2.

In addition, provided in the direct vicinity of the transitional portion 7 between the front extension portion 4 on the sole and the actual body portion of the sole 2 is a pair of transverse grooves 9 and 10 which, in the illustrated embodiment, are of the same substantially triangular cross-section as the longitudinally extending groove 3 and which extend through the longitudinal groove 3 and also through the side edges of the sole 2. The grooves 9 and 10 are thus open at the sides of the sole of the boot. The grooves 3, 9 and 10 are of substantially constant depth, over the length thereof, except of course in regard to the front end of the groove 3 as described above and as illustrated in FIG. 2.

It will be appreciated that the thickness of the sole 2, in relation to the depth of the grooves, is such that the strength required in respect of the sole 2 is not adversely affected.

Figure 3:
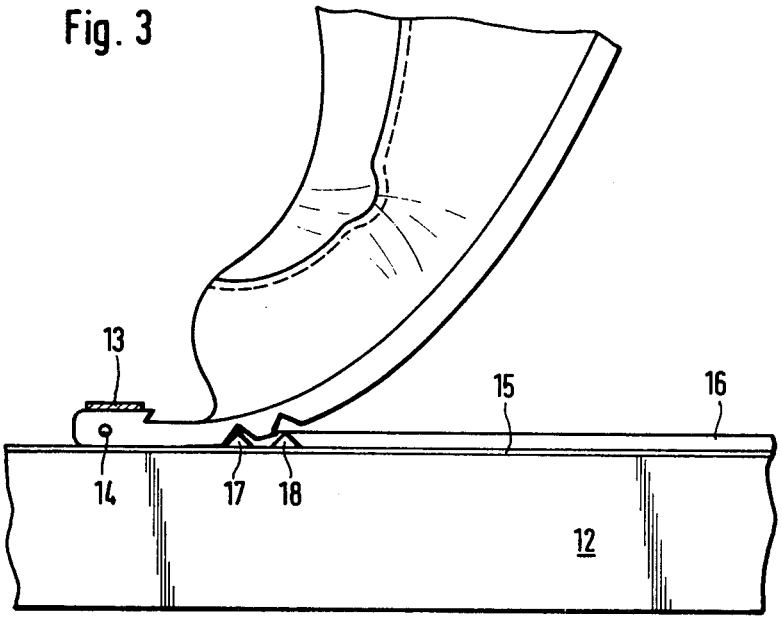
FIG. 3 shows the mutual interengagement of the grooves in the sole of the boot and ribs on the base plate on the ski in the course of the movement of the sole of the boot towards the top surface of the ski.

Reference will now be made to FIG. 3 which shows the region of the ski binding on a cross-country ski 12 and which also indicates in diagrammatic form the loop or clip 13 of a ski binding for rigidly fixing the above-mentioned front end region 5 of the extension portion 4 of the sole 2, on the top surface of the ski 12. The ski boot is prevented from accidentally coming loose from the holding clip 13 by a suitable locking element which is not shown in the drawing but which is for example in the form of a pin or peg which is inserted through the front end region 5 of the extension portion 4 and the clip member 13, in the region of a transverse bore 14 provided in the end portion 5. The binding may be for example of the general type as described in DE-AS (German published specification) No. 26 10 041 to which reference was made above. It should be noted however that the specific nature of the ski binding is not a relevant aspect in regard to the present invention.

Secured to the top surface of the ski 12 is a base plate 15 comprising a suitable material such as metal or plastic material and which has a raised rib 16 extending in the longitudinal direction of the base plate 15, and two transverse ribs 17 and 18 which thus extend substantially normal to the lengthwise rib 16. The spacing between the two transverse ribs 17 and 18 corresponds to the spacing between the two transverse grooves 9 and 10 in the sole 2 (see FIG. 1), while the ribs 16, 17 and 18 are of a cross-sectional shape that is complementary to that of the grooves 3, 9 and 10 in the sole 2.

FIG. 3 shows the ski boot in a position in which it has been lifted away from the top surface of the ski 12, for example in the phase of the skiing motion in which the cross-country skier is moving his rearward leg in a forward direction, at the end of the phase in which he pushed against the ski to propel himself forwardly. In the illustrated position of FIG. 3, the sole 2 which was previously bent away from the top surface of the ski 12 through an angle approaching 90°, with the bend occurring in the transitional portion indicated at 7 in FIG. 1, is being moved back towards the top surface of the ski 12 and is thus being set down on to the top surface of the ski again, with a rolling motion, as the degree of bending of the sole 2 is reduced. It will be clearly seen from FIG. 3 that, in the course of that downward rolling movement of the sole 2, the front transverse rib 17 on the base plate 16 engages over its entire length into the associated transverse groove 9 in the sole 2 so that it can immediately perform its full aligning and holding action, to resist lateral deformation and movement. Very quickly after the rib 17 has engaged into the groove 9, the transverse rib 18 will also engage into the associated transverse groove 10 in the sole 2. The two ribs 17 and 18 therefore engage into the corresponding grooves 9 and 10 in a phase of the skiing movement in which only a comparatively small portion of the longitudinal rib 16 is engaged with the associated longitudinal groove 3, so that the minimal interengagement of the groove 3 and the rib 16 cannot be expected to provide any substantial lateral support. However, the mutual sliding movement of the side surfaces of the longitudinal rib 16 and the longitudinal groove 3 against each other provides an aligning effect for correctly positioning the boot on the ski, that aligning effect promoting and assisting engagement of the transverse ribs 17 and 18 into the transverse grooves 9 and 10.

It will be appreciated that the above-described embodiment has been set forth only by way of example of the principles of the present invention and that various modifications and alterations may be made therein without departing from the spirit and scope of the invention. Thus for example, instead of the ribs and grooves being of the triangular cross-section illustrated, they may be of any other suitable cross-sectional shape, for example a trapezoidal shape, or a combination of a triangular and rectangular or square shape, and the like. In order to avoid a notch effect in the bottom of the transverse grooves 9 and 10, which could weaken the structure of the sole 2, it would also be possible for those grooves for example to be of a semicircular cross-section. In that respect, it is also possible to make use of the reduction in bending strength of the sole 2, which is due to the provision of the transverse grooves 9 and 10, so that the bending characteristics of the sole are deliberately affected to the desired end. That is achieved for example in that the depth of the transverse grooves is selected to be at its greatest value where the most severe bending action is desired, for example behind the transitional portion 7 between the front extension portion 4 and the main body portion of the sole 2, being the location at which, by virtue of the grooves being formed thereat, the thickness of the sole 2 increases in comparison with the thickness of the front extension portion 4. It should also be appreciated that a single transverse groove with corresponding transverse rib on the top surface of the ski or on the base plate is sufficient to provide the function in accordance with the principles of this invention. In an alternative form of the invention, instead of the sole having at least one groove therein, the sole may carry at least one transverse rib which therefore engages with a corresponding transverse groove on the top surface of the ski, for example in a base plate suitably secured thereto. If however a plurality of transverse grooves are provided in the sole for the above-described aim of affecting the bending characteristics of the sole, it is desirable for a base plate to be provided with correspondingly associated transverse ribs, so that the co-operation between the plurality of grooves and the plurality of ribs further enhances the aligning and holding function of the assembly.

In yet another alternative form of the illustrated embodiment, the sole may have at least one groove and also at least one rib, and the top surface of the ski or a base plate to be secured thereto may be similarly provided with at least one corresponding rib and also at least one corresponding groove adapted to co-operate with their counterparts on the sole of the boot. The engagement portions thus formed by the grooves and ribs will co-operate with each other in the same manner as described above for example with reference to FIG. 3, thereby to ensure that the sole of the boot is supported against lateral deflection or twisting movements with respect to the fixing points on the ski, at the member 13, even when the boot is in a position of being raised comparatively far away from the top of the ski.

What is claimed is:

1. In a cross-country ski boot, a sole comprising a front sole portion, a rear sole portion, a front extension portion extending forwardly from said front sole portion and having a rearward end connecting to said front sole portion and a forward end adapted to engage a ski binding means, a groove extending in the lengthwise direction of said sole in said front sole portion, rearwardly from a position at said rearward end of said extension portion, and at least one groove extending transversely in said front sole portion adjacent to said rearward end of said extension portion, said grooves being adapted to receive corresponding ribs on a ski to which said boot is to be fitted.

2. A boot as set forth in claim 1 and further including a second groove extending in said front sole portion at least substantially parallel to said at least one transverse groove at a position rearwardly thereof.

3. A boot as set forth in claim 1 wherein each said groove is of substantially triangular cross-section.

4. A boot as set forth in claim 1, wherein said transversely extending groove is disposed at a transitional portion between said front extension portion and said front sole portion.

5. A boot as set forth in claim 1, wherein said transversely extending groove extends across said lengthwise groove.

6. A boot as set forth in claim 1, wherein said transversely extending groove extends through at least one side edge of said sole.

7. A boot as set forth in cliam 1, wherein the depth of said transversely extending groove is substantially constant over the length thereof, for receiving an associated transverse rib on a ski, decreasing in height outwardly from the center of the sole.

* * * * *

UNITED STATES PATENT AND TRADEMARK OFFICE

CERTIFICATE OF CORRECTION

PATENT NO. : 4,551,931

DATED : November 12, 1985

INVENTOR(S) : Alfred Bente

It is certified that error appears in the above-identified patent and that said Letters Patent are hereby corrected as shown below:

Title page, Item [73] should read as follows:

-- Assignee: adidas Sportschuhfabriken Adi Dassler KG --

Signed and Sealed this

*Twenty-fifth* Day of *February 1986*

[SEAL]

*Attest:*

DONALD J. QUIGG

*Attesting Officer*

*Commissioner of Patents and Trademarks*